United States Patent [19]

Hediger

[11] Patent Number: 4,825,244

[45] Date of Patent: Apr. 25, 1989

[54] DEVELOPMENT STATION WITH IMPROVED MIXING AND FEEDING APPARATUS

[75] Inventor: Edwin A. Hediger, Fairport, N.Y.

[73] Assignee: Eastman Kodak Company, Rochester, N.Y.

[21] Appl. No.: 124,219

[22] Filed: Nov. 23, 1987

[51] Int. Cl.[4] ..... G03G 15/08

[52] U.S. Cl. ..... 355/3 DD; 355/14 D; 118/653

[58] Field of Search ..... 355/3 DD, 14 D; 118/653, 657, 658

[56] References Cited

U.S. PATENT DOCUMENTS

| | | | |
|---|---|---|---|
| 3,654,902 | 4/1972 | Hakanson | 118/637 |
| 3,998,537 | 12/1976 | Smith et al. | 355/3 DD |
| 4,146,323 | 3/1979 | Forward et al. | 355/3 DD |
| 4,173,405 | 11/1979 | Swapceinski et al. | 355/3 DD |
| 4,235,194 | 11/1980 | Wada et al. | 355/3 DD X |
| 4,274,362 | 6/1981 | Beck et al. | 118/657 |
| 4,324,483 | 4/1982 | Tagawa et al. | 355/3 DD |
| 4,634,286 | 1/1987 | Pike | 355/3 DD |
| 4,707,107 | 11/1987 | Joseph | 355/3 DD |

FOREIGN PATENT DOCUMENTS 0160830 11/1985 European Pat. Off. .

*Primary Examiner*—A. C. Prescott
*Assistant Examiner*—Jane Lau
*Attorney, Agent, or Firm*—Leonard W. Treash

[57] ABSTRACT

A development station for an eletrostatographic apparatus has an elongate sump for a two-component developer material. A feed screw drives developer material along a tube and through openings in the tube into the sump. A ribbon blender coaxially positioned wtih respect to the tube mixes the developer material, delivers it to a developer applicator for transfer to an electrostatic image, and returns the remaining developer material to the other end of the sump for mixture with fresh toner particles.

5 Claims, 2 Drawing Sheets

FIG. 2
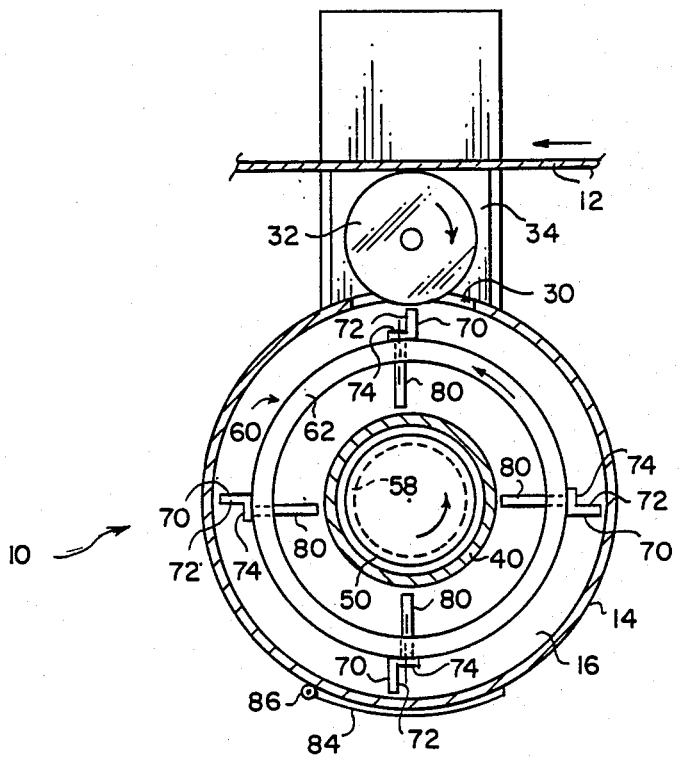
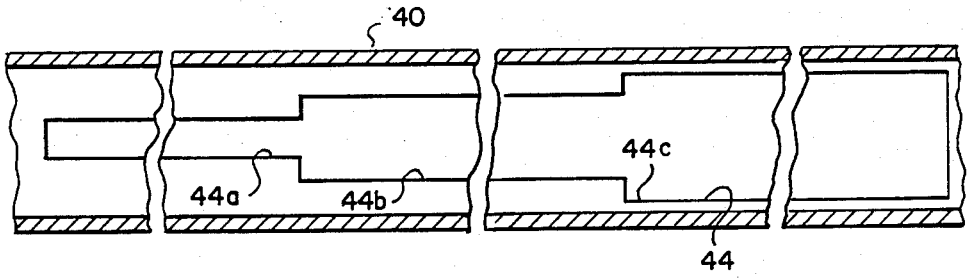
FIG. 3

DEVELOPMENT STATION WITH IMPROVED MIXING AND FEEDING APPARATUS

BACKGROUND OF THE INVENTION

The present invention relates to improvements in a development station for an electrostatographic apparatus, such as a copier/duplicator, printer or the like.

Commonly-assigned U.S. Pat. No. 4,173,405, entitled "Developer Distribution Apparatus" which issued on Nov. 6, 1979 in the names of J. P. Swapceinski et al, discloses a development station for a two-component developer material. Developer material is driven in two opposite directions by a pair of augers that are adjacent to each other and have generally parallel axes. One of the augers rotates in a tube that has a series of openings of different sizes divided into groups so that material driven through the tube by the auger will be metered through the holes. The material flows into a sump and is delivered to a magnetic brush used for developing latent electrostatic images.

It is also known to provide a development station of electrostatographic apparatus with ribbon blenders for mixing and moving two-component developer material in a sump. One such station is disclosed in European Patent Publication No. 160,830, published Nov. 13, 1985, the disclosure of such publication being based on copending commonly-assigned U.S. Patent Application Serial No. 597,323, filed Apr. 6, 1984 in the names of B. J. Joseph and T. K. Hilbert. In the European patent publication coaxial inner and outer ribbon blenders drive developer material in two opposite directions when the ribbon blenders are rotated about a common axes. The European patent publication also discloses feeder vanes located on the radially outer ribbons of one of the ribbon blenders for picking up material from the sump and delivering it to a magnetic brush. As explained in the EPO publication, ribbon blenders have been found to be especially desirable for mixing and moving two-component developer materials wherein the carrier particles of such material comprise "hard" magnetic carrier particles.

Electrostatographic reproduction apparatus utilizing two-component developer materials for development of latent images tend to be relatively large and expensive. Also, they do not always have a positive developer flow path that will guarantee high image quality over long term periods. In addition, when the carrier particles of two-component developer materials comprise "hard" magnetic particles, special handling techniques are required, as explained in the before-mentioned EPO publication.

SUMMARY OF THE INVENTION

Accordingly, it is an object of the invention to provide an improved development station for reproduction apparatus which is compact, relatively low cost, and provides a positive developer flow path for high image quality over long term periods.

In accordance with the present invention a development station for a reproduction apparatus includes a housing defining a sump for a supply of developer material comprising carrier particles and toner particles. The sump is elongate and generally cylindrical in shape and has first and second end portions. The housing has a first opening in the first end portion and a second opening in the second end portion. A cartridge mounting member is located at the first end portion of the housing with the member communicating with the first opening in the housing so that toner particles from a cartridge supported by the member can pass through the member and into the first end portion of the sump. A developer applicator receives developer material from the housing through the second opening. A generally cylindrical tube is coaxially positioned within the sump and extends substantially the entire length of the sump. The tube has a first opening positioned with respect to the first opening in the housing so that toner particles delivered into the housing through the cartridge mounting member can enter the tube. The tube has a second opening along the bottom of the tube generally beneath the applicator. A feed screw positioned within the tube positively drives developer material along the tube from the first opening to the second opening. A ribbon blender is rotatably mounted within the housing. The blender is coaxial with the tube and located between the tube and the housing. The screw is rotated in a direction for moving developer material from the first end portion of the housing toward the second end portion thereof. The ribbon blender is rotated in a direction for moving developer material from the second end portion of the housing toward the first end portion thereof. Means are provided for feeding developer material delivered into the sump from the tube to the applicator.

BRIEF DESCRIPTION OF THE DRAWINGS

In the detailed description of the preferred embodiment of the invention presented below, reference is made to the accompanying drawings, in which:

FIG. 2 is a transverse cross-section taken along line 2—2 in FIG. 1; and FIG. 3 is a fragmentary view of a portion of the bottom of the tube that receives the feed screw in the development station.

DETAILED DESCRIPTION OF THE INVENTION

Figure 1:
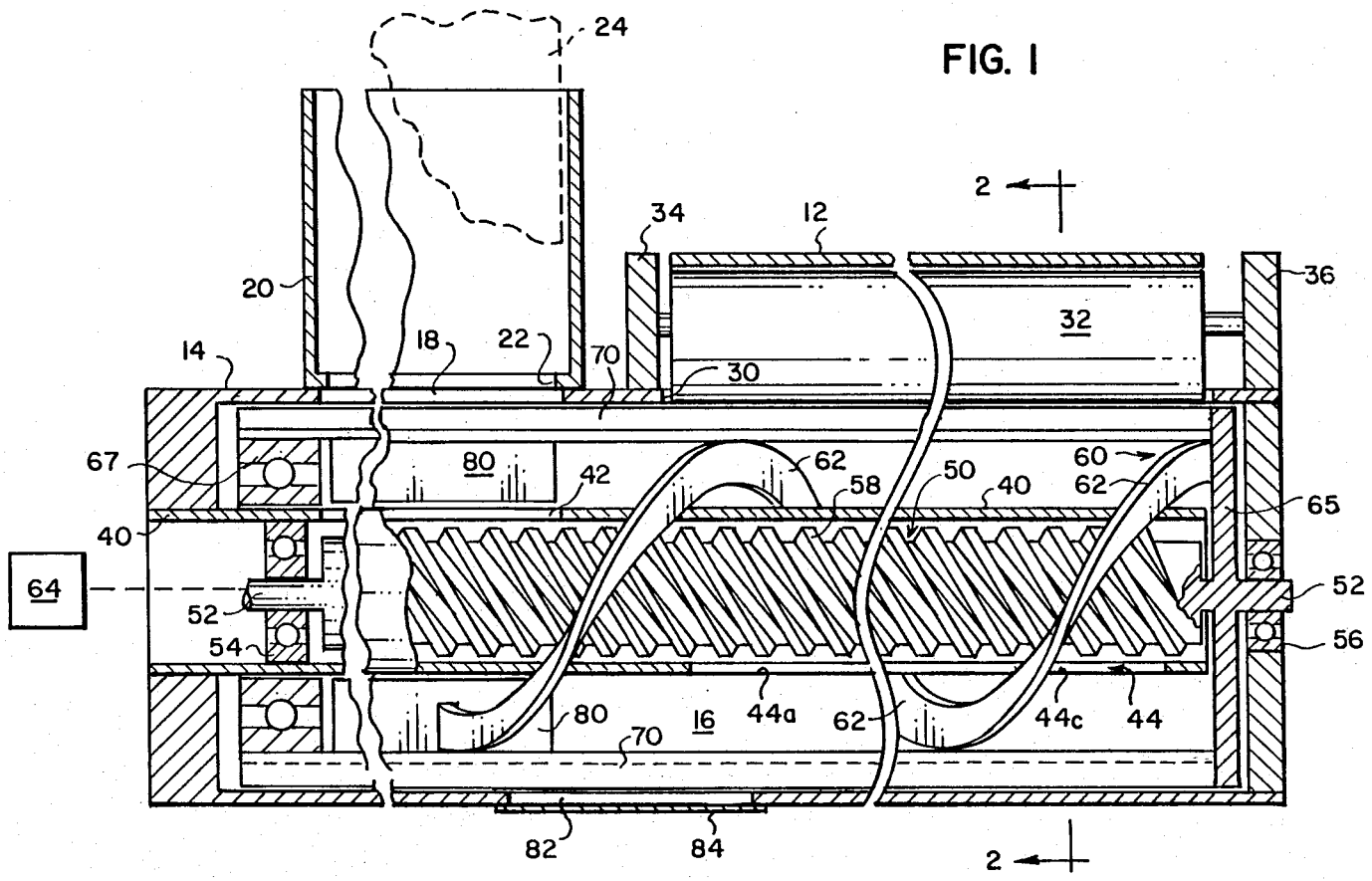
FIG. 1 is a fragmentary longitudinal cross-sectional view showing a development station of the present invention.

Referring now to the drawings in detail, a development station of the present invention is generally designated 10 and can be used for developing latent electrostatic images formed on a photoconductor 12 of an electrostatographic reproduction apparatus, such as a copier/duplicator, printer or the like. The development station comprises a housing 14 having a sump 16 for a supply of developer material, such as a two-component developer material comprising carrier particles and toner particles. The carrier and toner particles are mixed together in the sump, and some of the toner particles are transferred to the latent image on the photoconductor 12 to develop that image. The developer material may comprise hard magnetic carrier particles of the kind generally described in the before-mentioned EPO publication.

As best shown in FIGS. 1 and 2, the portion of housing 14 defining the sump 16 is elongate and at least the inner surface thereof defining the sump 16 is preferably generally cylindrical in shape. An opening 18 is provided in the top of housing 14 adjacent the left portion of the housing as viewed in FIG. 1. A toner cartridge mounting member 20 is secured to housing 14. The mounting member has an opening 22 that is aligned with opening 18 in the housing so that toner particles can pass through the openings 22 and 28 and enter the housing 14. The mounting member 20 is adapted to receive and support a cartridge or container 24 for toner particles. A metering mechanism (not shown) can be provided for controlling the flow of toner particles from the cartridge into housing 14 to maintain a desired toner concentration in the housing 14.

Housing 14 has a second opening 30 across the top of the housing 14 at the end portion of the housing opposite from opening 18. A developer applicator 32, such as a magnetic brush, is positioned with respect to opening 30 for receiving developer material from the sump 16 and applying the material to the lower surface of the photoconductor 12 to develop latent images on the photoconductor. Supports 34, 36 secured to the upper surface of housing 14 rotatably support the applicator 32.

An elongate, generally cylindrical tube 40 is co-axially positioned within the sump 16 and extends substantially the entire length of the sump and the housing 14. The tube is supported by the housing and is stationary within the housing. An elongate opening 42 in the left-end portion of the tube is substantially aligned with opening 18 in housing 14 and opening 22 in the cartridge mounting member 22 so that toner particles delivered from cartridge 24 through openings 22 and 18 can pass through the upper portion of housing 14 and directly enter opening 42 into the tube 40.

As best shown in FIGS. 1 and 3, tube 40 also has a second elongate opening 44 that extends a substantial distance in an axial direction along the bottom of the tube and facing the bottom of the sump 16. The left end of opening 44 is spaced from the right end of opening 42 to provide a zone within the tube for mixing and charging of the developer materials before they are discharged into the sump. The overall length of opening 44 is substantially equal to the length of the applicator 32, and the opening 44 is substantially aligned with the opening 30 for the applicator. In addition, the opening 44 varies in width from a relatively narrow end portion nearest the opening 42 to a relatively wide portion nearest the opposite end of the tube 40. More specifically, opening 44 preferably comprises elongate, generally rectangular portions 44*a*, 44*b* and 44*c* which are coaxially aligned along the length of the tube. Developer material provided to the tube 40 through opening 42 is discharged from the tube through opening 44. The shape of opening 44 provides good control of the toner concentration in the sump and to the photoconductor as explained in more detail later.

A screw conveyor generally designated 50 is positioned within tube 40 and extends substantially the full length of the tube. The screw conveyor comprises a shaft 52 that is rotatably supported in end portions of housing 14 by bearings 54, 56. The screw conveyor further comprises an elongate helical auger 58 supported by shaft 52 and having its outer edge in close-fitting relationship to the inside surface of the tube 40. In response to rotation of the shaft 52, the auger drives developer material through the feed tube from the opening 42 to the opening 44 in a positive, fully controlled manner that assures rapid delivery of the developer material from opening 42 to opening 44 and into the sump 16.

A ribbon blender generally designated 60 is positioned without housing 14 and coaxially located about the tube 40. The ribbon blender comprises an elongate continuous helical ribbon 62 having its inner edge spaced from tube 40 and having its outer edge spaced from the inner surface of housing 14. As best shown in FIG. 1, the pitch of the auger 58 of the screw conveyor is opposite from the pitch of the ribbon 62.

Both the shaft 52 of the screw conveyor and the ribbon blender 60 are coupled to a drive diagrammatically shown at 64 so that they are jointly rotated in the same direction about the axis of shaft 52. The blender and screw conveyor can be coupled together by a plate 65 that is fixed to the right end of shaft 52 and to the right end of the ribbon blender. A bearings 67 rotably supports the left end of the ribbon blender on tube 40. The direction of rotation of the conveyor and blender is selected so that the screw conveyor 50 is effective to move developer material from left to right as viewed in FIG. 1 while the ribbon blender is effective to move developer material from right to left as viewed in FIG. 1. The ribbon blender provides desirable mixing of carrier particles and toner particles in the sump 16 as well as conveying the developer mix from right to left.

Means are provided for feeding developer material from sump 16 to the applicator 32. The specific feed means illustrated in the drawings comprises a plurality of feed buckets 70. The buckets 70 each comprise a radially extending arm 72 and an arm 74 that is perpendicular to the arm 72. Feed buckets 70 are secured to the outer edge of ribbon blender 60 and arm 72 project radially outwardly therefrom. The buckets extend in an axial direction as best shown in FIG. 1, and preferably extend substantially the full length of the housing 14 from a point udner the right edge of applicator 32 to a point to the left of opening 18 in housing 14.

The radially outer edges of buckets 70 sweep through the bottom of sump 16 closely adjacent to the cylindrical wall of the housing 14 so that they are effective to pick up developer material from the bottom of the sump and bring it into close proximity to applicator 32. At that point the developer material is transferred to the applicator by magnets in the applicator and transported by the applicator to the photoconductor 12. Buckets 70 also serve to help mix the developer material in the sump by continually moving through the material in the sump. Also the buckets pick up from the bottom of the sump more material than is transferred to the applicator 32, and thus some of the material is returned to the sump and mixed with other material in the sump.

A plurality of baffles 80 are secured to the buckets 70 at the left end thereof as viewed in FIG. 1. Baffles 80 extend from the left end of the buckets to a point approximately in line with the right end of the opening 42 in the tube 40. The baffles project in a radial direction from the buckets inwardly to a point clearly adjacent to the outer surface of the tube 40. Thus during rotation of the ribbon blender and buckets, the baffles sweep through the left-end portion of sump 16, as viewed in FIG. 1, to pick-up substantially all of the developer material in that end portion of the sump and raise it from the bottom of the sump to a position directly in line with the opening 42 of the tube 40. Thus used or toner-depleted developer material moved from right to left in sump 16 by the ribbon blender is returned to opening 42 where it can be mixed with fresh toner delivered through openings 18 and 22 in housing 14 and cartridge mounting member 20, respectively. The used developer material and fresh toner particles are thoroughly mixed together as they are transported in a left to right direction by the screw conveyor 50.

Preferably an opening 82 is provided in the bottom of housing 14. Normally the opening 82 is closed by a gate 84 which is hinged at 86 (FIG. 2) to the housing 14. By opening the door developer material in sump 16 can be discharged from the sump. Such removal of developer material is facilitated by operating the screw conveyor 50 and ribbon blender to circulate material through the development station while the door is opened.

During operation of the development station drive 64 rotates shaft 52 to turn the auger, the ribbon blender 60 and the buckets. Fresh toner particles are supplied to the developer mix from container 24 through the mounting member 20 and openings 22 and 18 in the mounting member and the housing, respectively. Such toner particles are immediately mixed with toner-depleted developer lifted by the baffles 80 in the left end of the sump 16, and then the combustion thereof passes through the opening 42 in the tube 40. The screw conveyor 50 drives the developer mix to the right as viewed in FIG. 1. As the developer mix reaches opening 44 in the bottom of tube 40, some of it will initially drop through the relatively small portion 44a of the opening 44 into that portion of the sump that is substantially immediately beneath the left end portion of the applicator 32. This fresh developer mix then can be furnished to the applicator 32 by the buckets 70. Additional portions of the fresh developer mix reach and pass through the intermediate portion 44*b* of opening 44 and is provided to the central portion of the applicator 32. Still further portions of the fresh developer mix reach the largest end portion 44*c* of opening 44 in the right end of the tube 40 and drop into the right end portion of the sump 16. This portion of the developer mix can be provided to the right end portion of applicator 32. In addition, the ribbon blender 60 is driven in a direction which mixes and feeds the developer mix in sump 16 from the right to the left as viewed in FIG. 1, thus continuously changing the mixture of developer material provided to the applicator 32. As a result, the concentration of toner particles in the developer mix provided to applicator 32 is substantially constant throughout the length of the applicator. As the developer in sump 16 reaches the left end portion of the housing 14, baffles 80 lift the toner-depleted developer mix from the bottom of the sump and deliver it to the opening 42 where it is mixed with fresh toner particles for recycling through the development station.

Most of the developer mix driven through tube 40 is discharged through portion 44c of opening 44 and is available for developing images on all portions of the photoconductor because the ribbon blender drives such material from right to left. Lesser quantities of the developer mix are discharged through portions 44a and 44b of opening 44. However, lesser quantities are needed in these parts of the station for two reasons. First of all, the material discharged through portionf 44a and 44b are only used for developing images on the left and central portions of the photoconductor as viewed in FIG. 1. Secondly, some of the material discharged through portion 44cc of the opening is also available to develop images on the left part of the photoconductor.

The apparatus defines three distinct functional areas. The first area is at the left end portion of FIG. 1 and comprises a replenishment area. The second area comprises the area in tube 40 to the left of opening 44 where pre-mixing and pre-charging of the developer material takes place. The third area is the right end portion of the apparatus where continuous mixing of new toner and used developer occurs in the sump, and where some of the developer is furnished to the applicator.

The development station of the present invention provides a very compact, relatively low-cost development station due, in part, to the fact that it is a coaxial system in which fresh developer is moved to the right inside tube 40 and returned to the left by the ribbon blender 60. This construction makes it possible to fully utilize a relatively small amount of space and also results in the station being relatively low in cost.

Another advantage of the development station of the invention is that a positive flow of developer material is achieved through the use of the stationary tube 40 and the screw conveyor 50. This arrangement also separates the 'toner-replenished' developer mix inside tube 40 from the 'toner-depleted' developer mix in the bottom of sump 16 and to the left of opening 44. As a result the toner replenished developer mix is transported to a position directly under the applicator 32 before it is mixed with other portions of the developer mix, and this assures that the toner replenished portion of the developer mix is quickly and completely transported to the position where it is needed for developing images on the photoconductor 12.

A further advantage of the development station of this invention is that the circular, coaxial flow pattern achieved by the combination of the screw conveyor 50 and the ribbon blender provides for "uniform" developer "aging". This aging is achieved during circulation of the toner-replenished developer mix from opening 42 in tube 40 to the opening 44. In addition, at the end of the useful life of the developer mix the developer is easily removed from the development station by swinging the gate 84 about hinge 86 and operating the system until all of the aged developer is removed through opening 82.

The invention has been described in detail with particular reference to a preferred embodiment thereof, but it will be understood that variations and modifications can be effected within the spirit and scope of the invention as described hereinabove and as defined in the appended claims.

I claim:

1. A development station for a reproduction apparatus, the station comprising:

a housing defining a sump for a supply of developer material comprising carrier particles and toner particles, the sump being elongate and generally cylindrical in shape and having first and second end portions, the housing having a first housing opening in the first end portion thereof and a second housing opening in the second end portion thereof, a cartridge mounting member secured to the housing at the first end portion thereof with the member located directly above and communicating with the first housing opening so that toner particles from a cartridge supported by the member can fall through the member and mix with carrier particles in the first end portion of the sump, a developer applicator located above the housing, axially spaced from a received cartridge and generally aligned with the second housing opening for receiving developer material from the housing, a generally cylindrical tube coaxially positioned within the sump and extending substantially the entire length thereof, the tube having a first tube opening therein positioned below the first housing opening so that carrier particles with fresh toner particles delivered into the housing through the cartridge mounting member can enter the tube, and the tube having a second tube opening therein along the bottom of the tube generally beneath the applicator, a feed screw positioned within the tube for positively driving developer material along the tube from the first tube opening to the second tube opening, a ribbon blender rotatably mounted within the housing coaxial with the tube and between the tube and the housing, drive means for rotating the screw in a direction for moving developer material including both carrier particles and toner particles from the first end portion of the housing toward the second end portion thereof and for rotating the ribbon blender in a direction for moving developer material from the second end portion of the housing to the first end portion thereof where said developer receives fresh toner particles directly through the first housing opening thereby providing a continuous mixing cycle including the portion of housing and tube under the cartridge, and means for feeding developer material delivered into the sump from the tube to the applicator.

2. The development station as set forth in claim 5, wherein the feeding means comprises a plurality of buckets carried by the ribbon blender, the buckets being movable by the ribbon blender through the sump where the buckets pick up developer material and then to a position adjacent the applicator where developer material can be transferred to the applicator.

3. The development station as set forth in claim 5, wherein the second tube opening has a first portion nearest the first tube opening and a second portion further from the first tube opening than the first portion, the portions of the opening being generally aligned with each other and generally rectangular in shape and the first portion being circumferentially narrower than the second portion.

4. The development station as set forth in claim 5, further comprising a plurality of baffles between the housing and the portion of the tube containing the first tube opening, and the baffles being rotated through the sump and then past the first tube opening so that developer material can be moved from the sump into the tube for delivery to the second tube opening, thereby recirculating the developer material in the station.

5. The development station according to claim 1, wherein the second tube opening extends substantially the full length of the portion of the tube directly under the applicator.

* * * * *